US012195155B2

(12) United States Patent
Mizutani et al.

(10) Patent No.: US 12,195,155 B2
(45) Date of Patent: Jan. 14, 2025

(54) OUTBOARD MOTOR

(71) Applicant: YAMAHA HATSUDOKI KABUSHIKI KAISHA, Iwata (JP)

(72) Inventors: Makoto Mizutani, Shizuoka (JP); Tomohiro Hagi, Shizuoka (JP); Motosumi Yamanouchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 467 days.

(21) Appl. No.: 17/520,777

(22) Filed: Nov. 8, 2021

(65) Prior Publication Data

US 2022/0194540 A1 Jun. 23, 2022

(30) Foreign Application Priority Data

Dec. 22, 2020 (JP) ..... 2020-212111

(51) Int. Cl.

| | |
|---|---|
| ***B63H 20/32*** | (2006.01) |
| ***B63H 20/02*** | (2006.01) |
| ***B63H 20/10*** | (2006.01) |
| ***B63H 20/12*** | (2006.01) |
| ***B63H 23/34*** | (2006.01) |

(52) U.S. Cl.

CPC ..... *B63H 20/32* (2013.01); *B63H 20/02* (2013.01); *B63H 20/10* (2013.01); *B63H 20/12* (2013.01); *B63H 23/34* (2013.01)

(58) Field of Classification Search

CPC ..... B63H 20/32; B63H 20/02; B63H 20/10; B63H 20/12; B63H 23/34

See application file for complete search history.

(56) References Cited

U.S. PATENT DOCUMENTS

| | | | | |
|---|---|---|---|---|
| 4,080,099 | A * | 3/1978 | Snyder | B63H 5/165 416/234 |
| 5,487,687 | A | 1/1996 | Idzikowski et al. | |
| 9,376,191 | B1 | 6/2016 | Jaszewski | |
| 2005/0250394 | A1 | 11/2005 | Nakamura et al. | |
| 2007/0254539 | A1 * | 11/2007 | Yazaki | F02B 61/045 440/77 |
| 2009/0170385 | A1 | 7/2009 | Fukuoka | |

FOREIGN PATENT DOCUMENTS

JP 2009-160970 A 7/2009

OTHER PUBLICATIONS

Official Communication issued in corresponding European Patent Application No. 21201678.6, mailed on Apr. 8, 2022.

* cited by examiner

*Primary Examiner* — Stephen P Avila

(74) *Attorney, Agent, or Firm* — Keating & Bennett, LLP

(57) ABSTRACT

An outboard motor includes an upper case located between an engine and a propulsion unit. The upper case includes case parts that are separate from each other and assembled together. The case parts include a first case part and a second case part opposing each other in a direction perpendicular or substantially perpendicular to an axis of a drive shaft.

18 Claims, 11 Drawing Sheets

OUTBOARD MOTOR

CROSS REFERENCE TO RELATED APPLICATIONS

This application claims the benefit of priority to Japanese Patent Application No. 2020-212111 filed on Dec. 22, 2020. The entire contents of this application are hereby incorporated herein by reference.

BACKGROUND OF THE INVENTION

1. Field of the Invention

The present invention relates to an outboard motor.

2. Description of the Related Art

There are conventional outboard motors known in the art that include a propulsion unit having a propeller, an engine that drives the propulsion unit, and a drive shaft that transmits the power of the engine to the propulsion unit (see, for example, JP A 2009-160970). The engine is arranged upward of the propulsion unit and is covered by a cover. A case is provided between the engine and the propulsion unit. The engine is secured to an upper portion of the case, and the propulsion unit is secured to a lower portion of the case. The engine and the propulsion unit are supported on the case. The drive shaft extends downward from the engine. The propulsion unit is connected to the lower end portion of the drive shaft.

The case receives a load from the engine and the propulsion unit. The case is a part that serves the role as a frame for stably supporting the engine and the propulsion unit, and needs to have a sufficient mechanical strength. Since the case is arranged between the engine and the propulsion unit, the case serves the role of guiding the drive shaft extending downward from the engine toward the propulsion unit. Therefore, the case is formed in a tubular shape so as to surround the drive shaft. With conventional outboard motors, the case is manufactured by casting.

In recent years, outboard motors are becoming more and more complicated in structure. With casting, however, it is necessary to ensure a draft, and it is difficult to manufacture cases with complicated shapes.

With a large-sized outboard motor, the dimension of the case in the up-down direction is large. With casting, however, it is difficult to manufacture a case having a large dimension in the up-down direction. Therefore, in order to manufacture a case having a large dimension in the up-down direction, it is necessary to manufacture an upper case part and a lower case part by casting and then assemble them together. This, however, results in a problem that the upper and lower case parts each need to have a flange for the assembly, thereby increasing the weight of the case.

SUMMARY OF THE INVENTION

Preferred embodiments of the present invention provide outboard motors that are each easily manufactured while providing a sufficient mechanical strength and preventing an increase in weight even when the case has a complicated or large-sized configuration.

An outboard motor according to a preferred embodiment of the present invention includes an engine; a propulsion unit located below the engine and including a propeller; a drive shaft connected to the engine and the propulsion unit to transmit a drive force from the engine to the propulsion unit; and a case located between the engine and the propulsion unit. The case includes an engine attachment portion to which the engine is attached and a propulsion unit attachment portion to which the propulsion unit is attached. The case includes a plurality of case parts that are separate from each other and assembled together. The plurality of case parts include a first case part and a second case part opposing each other in a direction perpendicular or substantially perpendicular to an axis of the drive shaft.

With the outboard motor described above, the case is obtained by assembling together a plurality of case parts. As compared with the case that is made of a single part, the plurality of case parts each have a relatively simple and small configuration. Therefore, it is possible to relatively easily manufacture the case even when the case has a complicated or large configuration. The plurality of case parts include a first case part and a second case part that oppose each other in the direction perpendicular to the axis of the drive shaft. When the first case part and the second case part are assembled on top of each other, they need to have a flange, which leads to an increase in weight, but there is no need for such a flange. Therefore, with the outboard motor described above, even when the upper case has a complicated or large configuration, it is possible to prevent an increase in weight while providing a sufficient mechanical strength.

According to preferred embodiments of the present invention, it is possible to provide outboard motors that are each easily manufactured while providing a sufficient mechanical strength and preventing an increase in weight even when the case has a complicated or large-sized configuration.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
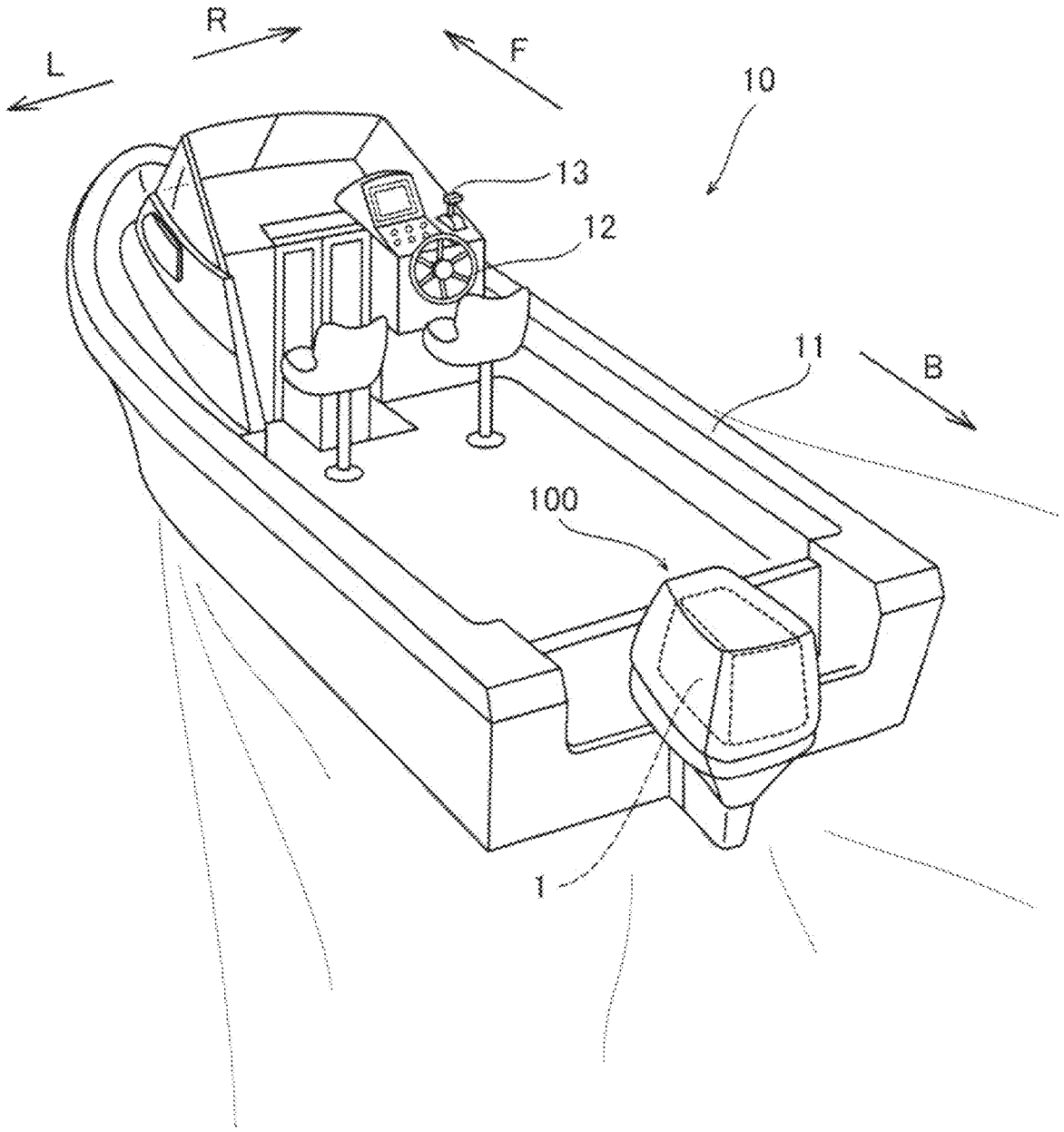
FIG. 1 is a perspective view showing a watercraft including an outboard motor according to a preferred embodiment of the present invention.

Preferred embodiments of the present invention will now be described with reference to the drawings. FIG. 1 shows a watercraft 10 including an outboard motor 100 according to the present preferred embodiment. The terms front, rear, left, and right, as used in the description below, refers to these directions as viewed facing the forward direction of the watercraft 10, while an axis 7*c* of a drive shaft 7 to be described below extends vertically and the outboard motor 100 is not inclined left and right relative to a hull 11. The designations F, B, L, and R, as used in the figures, refer to front, rear, left, and right, respectively.

The watercraft 10 includes the hull 11, a steering wheel 12, a remote controller 13, and the outboard motor 100. The outboard motor 100 is attached to the rear portion of the hull 11.

The steering wheel 12 steers the hull 11. As the passenger of the watercraft 10 operates the steering wheel 12, the outboard motor 100 rotates leftward or rightward relative to the hull 11. It is possible to shift gears of the outboard motor 100. By operating the remote controller 13, the passenger is able to switch the state of the outboard motor 100 between forward, backward, and neutral. The outboard motor 100 includes an engine 1 including a throttle valve (not shown). By operating the remote controller 13, the passenger is able to adjust the opening of the throttle valve. By adjusting the opening of the throttle valve, it is possible to adjust the output power of the outboard motor 100.

Figure 2:
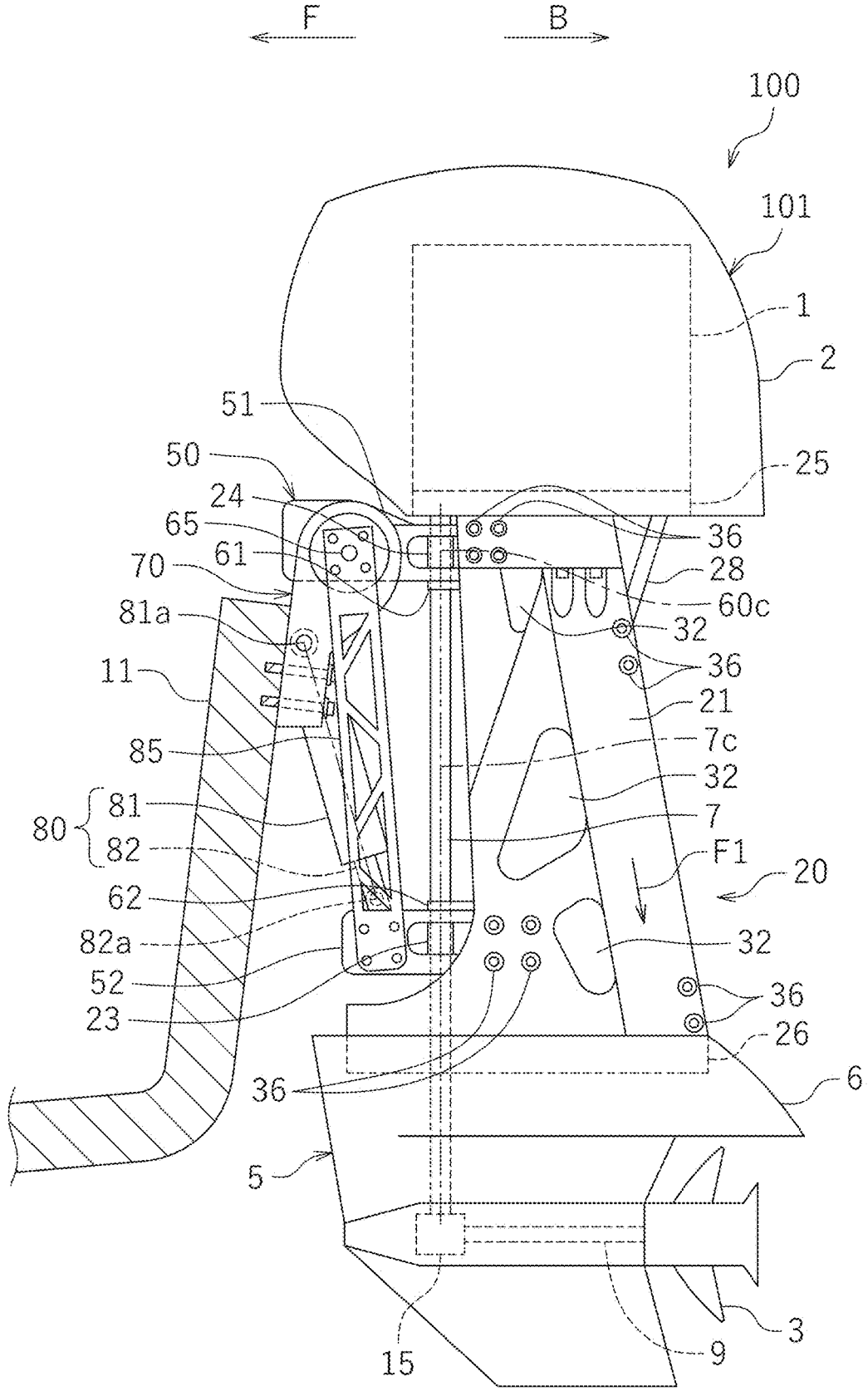
FIG. 2 is a side view showing an outboard motor according to a first preferred embodiment of the present invention.

FIG. 2 is a side view showing the outboard motor 100. The outboard motor 100 includes an outboard motor main unit 101, a support member 50 to support the outboard motor main unit 101, and an attachment member 70 to attach the support member 50 to the hull 11.

The outboard motor main unit 101 includes the engine 1, a propulsion unit 5 including a propeller 3, the drive shaft 7 connected to the engine 1 and the propulsion unit 5, and an upper case 20. The upper case 20 is located between the engine 1 and the propulsion unit 5. The engine 1 is located above the upper case 20. The propulsion unit 5 is located below the upper case 20 and below the engine 1.

The engine 1 is an internal combustion engine that is driven through combustion of fuel such as gasoline or diesel oil, for example. The engine 1 is covered by a cover 2.

The drive shaft 7 transmits power output from the engine 1 to the propulsion unit 5. The drive shaft 7 extends downward from the engine 1. The drive shaft 7 rotates by being driven by the engine 1.

The propulsion unit 5 includes a propeller shaft 9 on which the propeller 3 is provided, a gear device 15 that links together the drive shaft 7 and the propeller shaft 9, and a lower case 6. The gear device 15 transmits the rotation of the drive shaft 7 to the propeller shaft 9 while decelerating the rotation. Although not shown in the figure, the gear device 15 includes a pinion gear, a forward bevel gear, a backward bevel gear, and a dog clutch. A gear device well known in the art may be suitably used as the gear device 15. The propeller 3 rotates together with the propeller shaft 9, thus generating forward or backward propulsion.

The upper case 20 includes a plurality of case parts 21 to 26 to be described below. These case parts 21 to 26 are manufactured separately from each other. That is, the plurality of case parts 21 to 26 are separate parts.

The upper case 20 includes an upper plate part 25 and a lower plate part 26 as case parts. Here, the upper plate part 25 and the lower plate part 26 each have a horizontal plate shape, for example. Note, however, that there is no particular limitation on the shape of the upper plate part 25 and the lower plate part 26. The upper plate part 25 and the lower plate part 26 extend in the left-right direction and in the front-rear direction. The engine 1 is attached to the upper plate part 25. The upper plate part 25 is an example of the "engine attachment portion" to which the engine 1 is attached. A propulsion unit 6 is attached to the lower plate part 26. The lower plate part 26 is an example of the "propulsion unit attachment portion" to which the propulsion unit 6 is attached.

Figure 3:
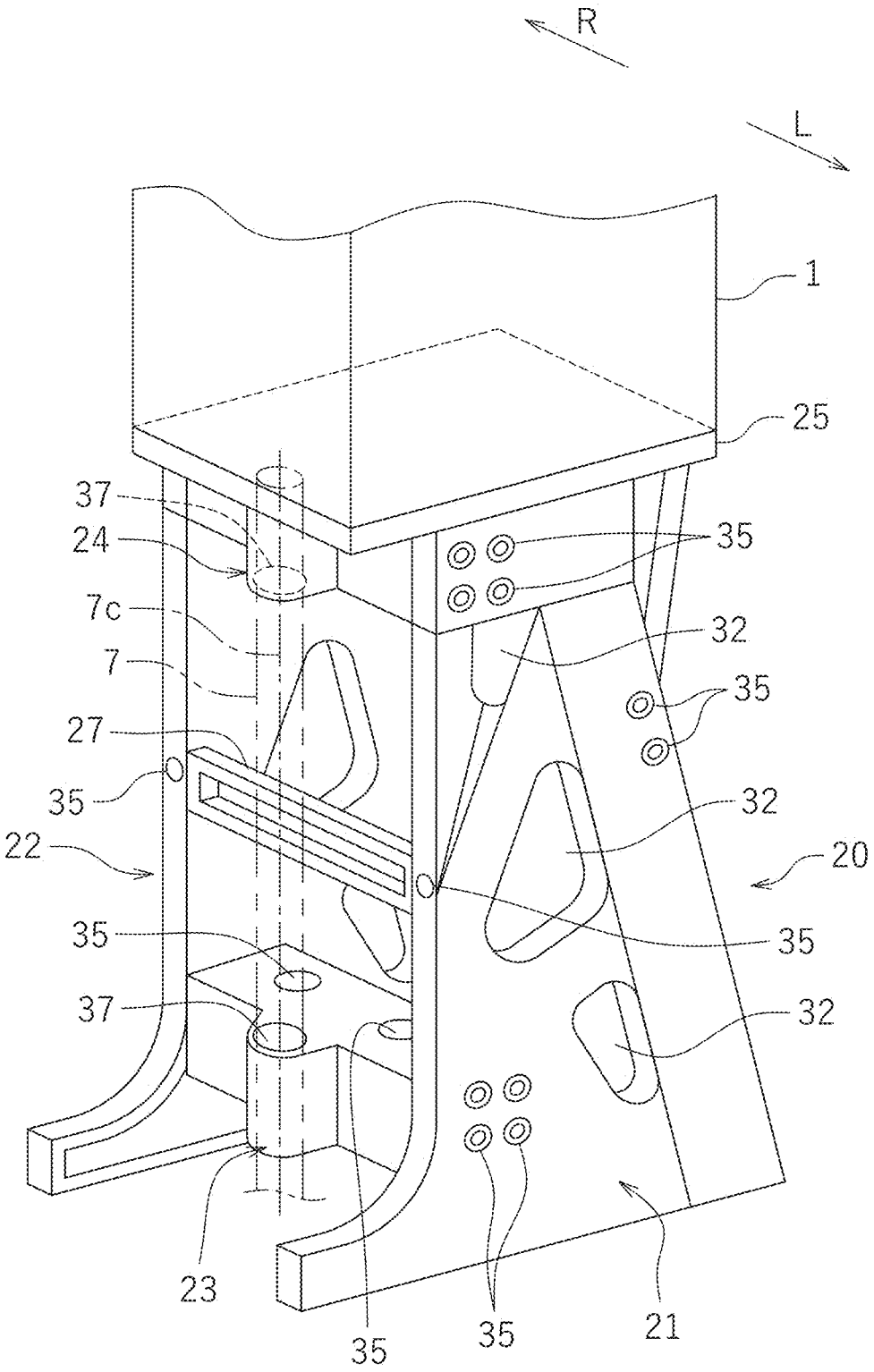
FIG. 3 is a perspective view showing a portion of an upper case of the outboard motor according to the first preferred embodiment of the present invention.
Figure 4:
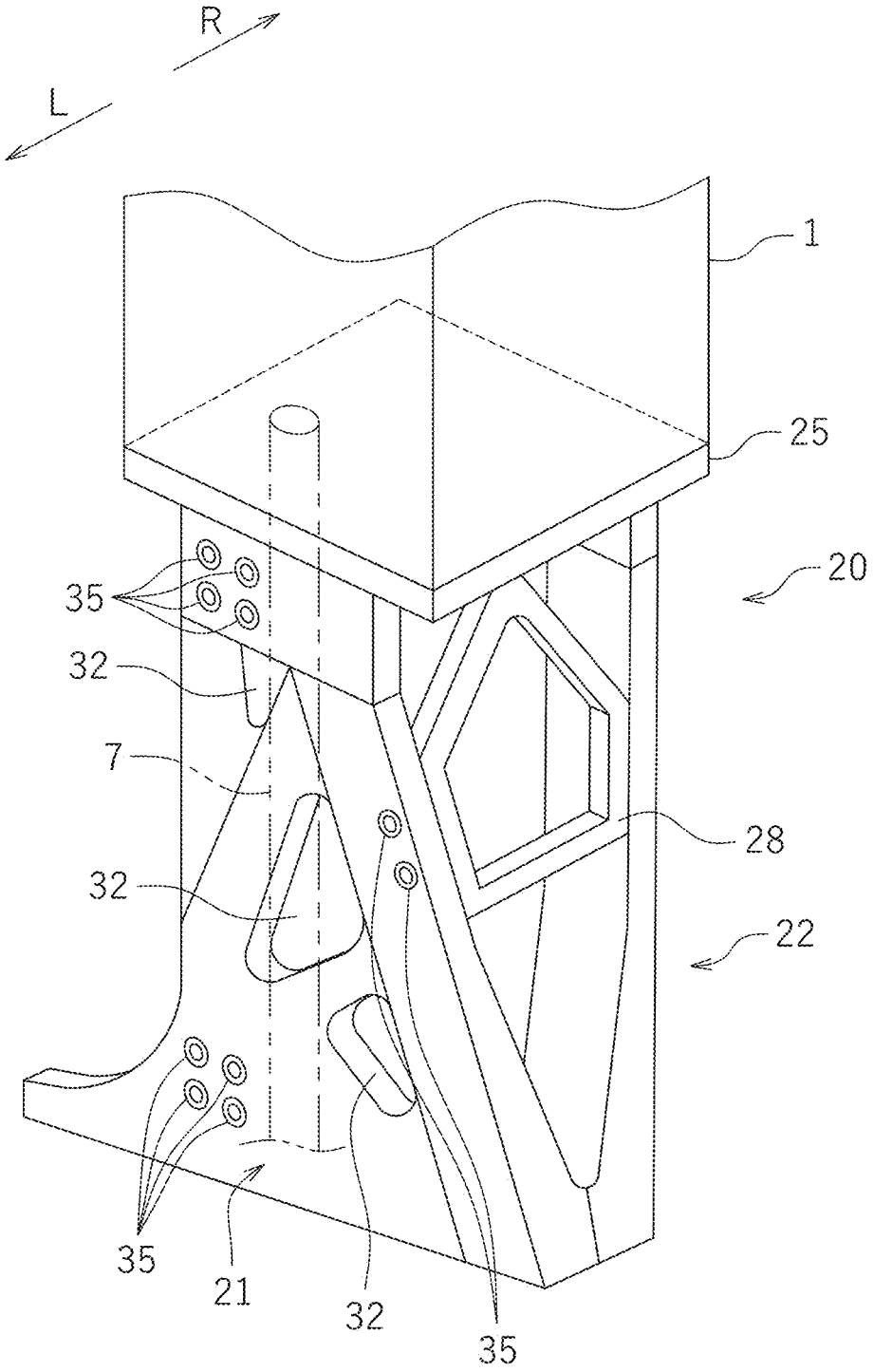
FIG. 4 is a perspective view showing a portion of the upper case of the outboard motor according to the first preferred embodiment of the present invention.

As shown in FIG. 3 and FIG. 4, the upper case 20 includes, as case parts, a first case part 21 and a second case part 22 that oppose each other in the direction perpendicular to the axis 7*c* of the drive shaft 7. The first case part 21 and the second case part 22 each extend in the up-down direction. The first case part 21 and the second case part 22 each also extend in the front-rear direction. The drive shaft 7 is located between the first case part 21 and the second case part 22. In the present preferred embodiment, the second case part 22 is located rightward of the first case part 21. The first case part 21 is located leftward of the drive shaft 7, and the second case part 22 is located rightward of the drive shaft 7.

Figure 5:
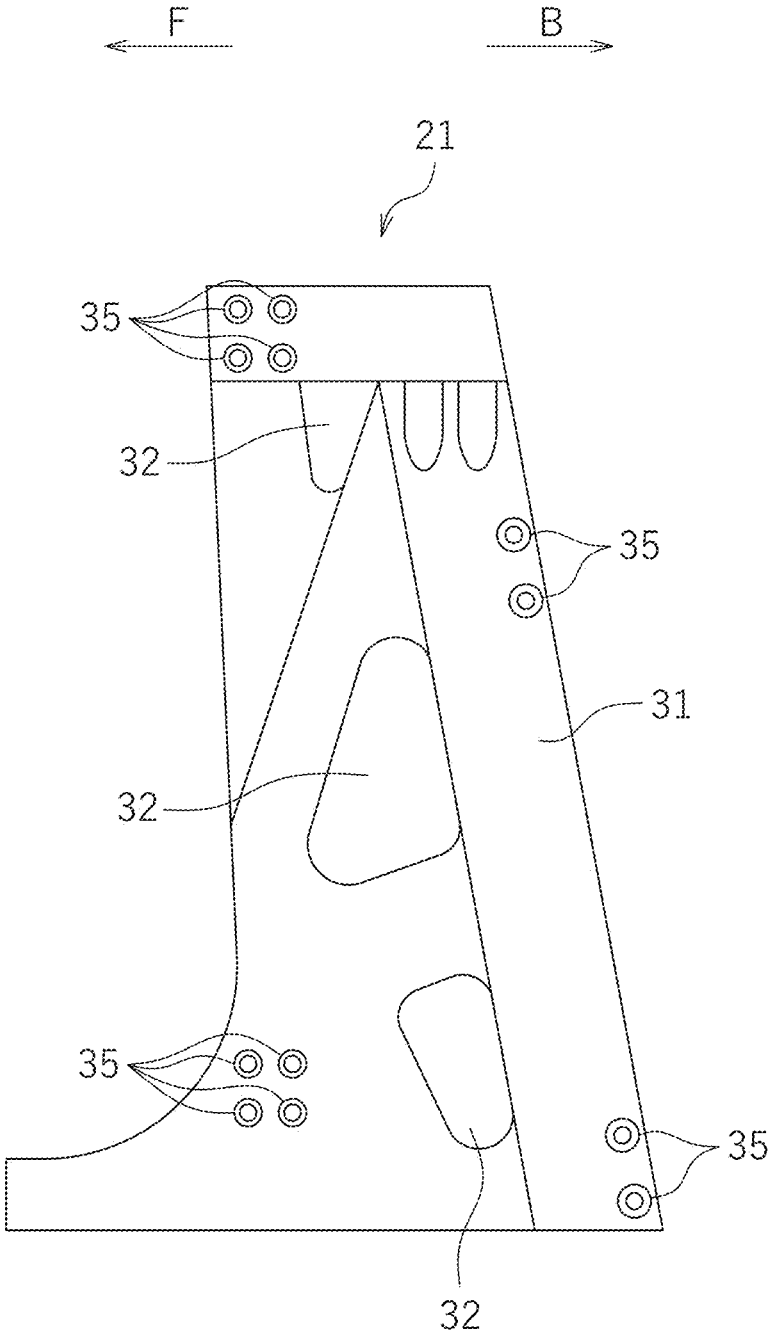
FIG. 5 is a front surface view showing a first case part of the outboard motor according to the first preferred embodiment of the present invention.
Figure 6:
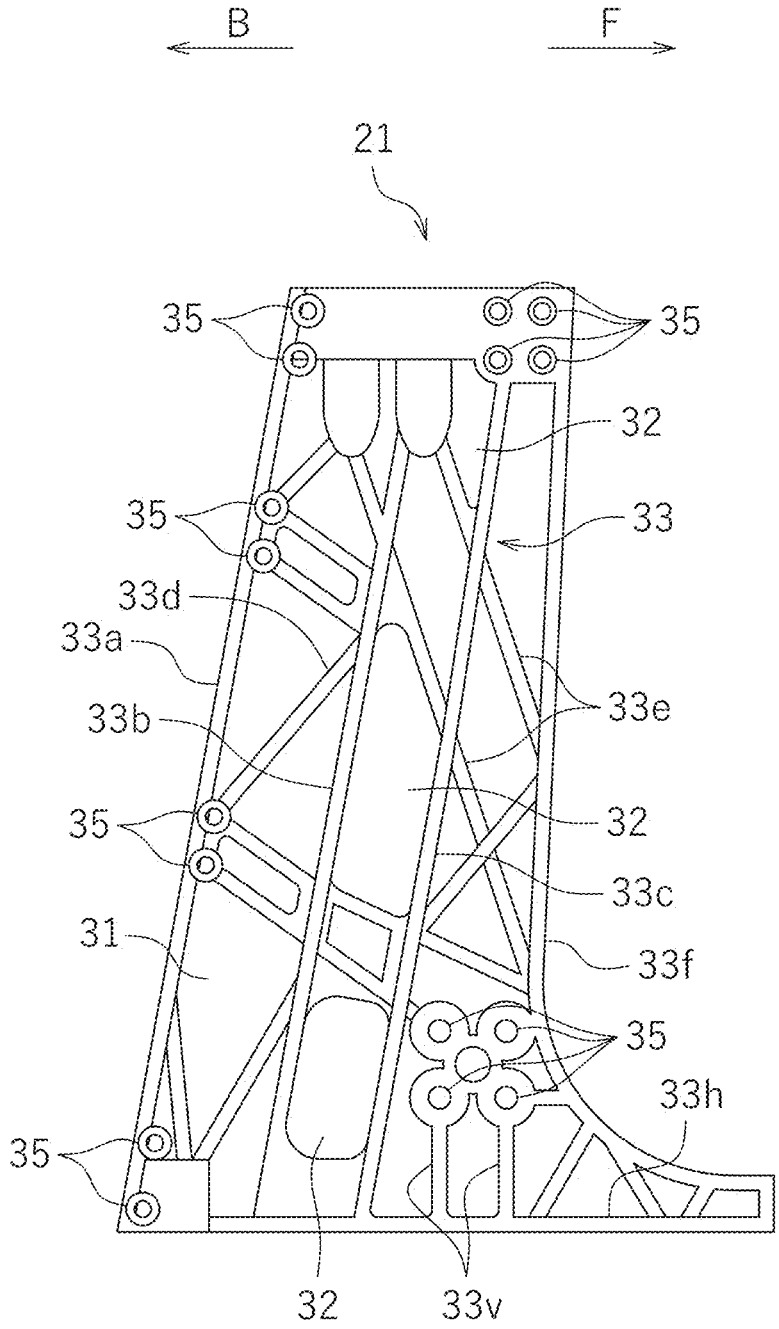
FIG. 6 is a reverse surface view showing the first case part of the outboard motor according to the first preferred embodiment of the present invention.

FIG. 5 is a front surface view showing the first case part 21 as viewed from the left side. FIG. 6 is a reverse surface view showing the first case part 21 as viewed from the right side. The first case part 21 includes a main body 31 having a curved plate shape extending in the up-down direction and the front-rear direction, and a plurality of reinforcement ribs 33 provided on the main body 31. The dimension of the first case part 21 in the up-down direction is larger than that in the front-rear direction and larger than that in the left-right direction.

As shown in FIG. 6, the reinforcement ribs 33 are provided on the reverse side of the main body 31. The reinforcement ribs 33 are each defined by an elongated projection that protrudes from the reverse-side surface of the main body 31. The reinforcement ribs 33 include a horizontal rib 33*h* extending in the horizontal direction, slanted ribs 33*a*, 33*b*, 33*c* and 33*d* extending rearward and downward, a slanted rib 33*e* extending rearward and upward, a vertical rib 33*v* extending in the vertical direction, and a curved rib 33*f* that is curved.

The horizontal rib 33*h*, the slanted rib 33*a* and the curved rib 33*f* are provided along the edge of the main body 31. The slanted ribs 33*b*, 33*c*, 33*d* and 33*e* and the vertical rib 33*v* are provided on the inside of the edge of the main body 31.

As described above, the axis 7*c* of the drive shaft 7 extends in the vertical direction. The slanted ribs 33*a*, 33*b*, 33*c*, 33*d* and 33*e* each extend in a slanted direction relative to a direction parallel to the axis 7*c* of the drive shaft 7. The slanted ribs 33*a*, 33*b* and 33*c* extend rearward and downward. In other words, a slanted ribs 33*a*, 33*b* and 33*c* extend toward the propeller 3 as they extend rearward. The horizontal rib 33*h* extends in a direction perpendicular or substantially perpendicular to a direction parallel to the axis 7*c* of the drive shaft 7.

As shown in FIG. 5, the main body 31 includes through holes 32. The through holes 32 are open in a direction perpendicular or substantially perpendicular to the axis 7*c* of the drive shaft 7. Here, the through holes 32 open leftward and rightward. In the present preferred embodiment, the main body 31 includes three through holes 32, for example. Note, however, that there is no limitation on the number of through holes 32. The number of through holes 32 may be two or four or more. The number of through holes 32 is not limited to more than one, but may be one. The through holes 32 are provided so as to reduce the weight of the first case part 21. In the present preferred embodiment, the three through holes 32 are arranged in the up-down direction. Note, however, that there is no particular limitation on the arrangement of the through holes 32. There is no limitation on the shapes of the through holes 32.

The second case part 22 has a shape that has left-right symmetry with the first case part 21. Therefore, elements of the second case part 22 corresponding to those of the first case part 21 are denoted by like reference signs, and the configuration of the second case part 22 will not be described.

As shown in FIG. 3, the upper case 20 includes, as case parts, a third case part 23 and a fourth case part 24 connected to the first case part 21 and the second case part 22, respectively. The third case part 23 and the fourth case part 24 bridge the first case part 21 and the second case part 22. The third case part 23 and the fourth case part 24 extend in the left-right direction. Here, the third case part 23 and the fourth case part 24 extend perpendicular or substantially perpendicular to the first case part 21 and the second case part 22. Note, however, that there is no limitation thereto. The third case part 23 or the fourth case part 24 may be slanted relative to at least one of the first case part 21 and the second case part 22. The fourth case part 24 is located above the third case part 23. The third case part 23 is located below a middle position of the first case part 21 and the second case part 22 in the up-down direction. The fourth case part 24 is located above the middle position of the first case part 21 and the second case part 22 in the up-down direction. The third case part 23 and the fourth case part 24 each include a hole 37 through which a steering shaft 61, 62 (see FIG. 2) to be described below is inserted.

As shown in FIG. 3, a first reinforcement member 27 is connected to the first case part 21 and the second case part 22. The first reinforcement member 27 bridges the first case part 21 and the second case part 22. The first reinforcement member 27 extends in the left-right direction. Here, the first reinforcement member 27 extends perpendicular or substantially perpendicular to the first case part 21 and the second case part 22. Note, however, that there is no limitation thereto. The first reinforcement member 27 may be slanted relative to at least one of the first case part 21 and the second case part 22. The first reinforcement member 27 is located above the third case part 23 and below the fourth case part 24.

As shown in FIG. 4, a second reinforcement member 28 is connected to the first case part 21, the second case part 22, and the upper plate part 25. The second reinforcement member 28 preferably has a triangular ring shape. The second reinforcement member 28 bridges the first case part 21, the second case part 22, and the upper plate part 25. The second reinforcement member 28 is located above the third case part 23.

The upper case 20 is obtained by assembling together the plurality of case parts 21 to 26. In the present preferred embodiment, the plurality of case parts 21 to 26 include bolt holes 35. The plurality of case parts 21 to 26 are assembled together by bolts 36, for example, inserted through these bolt holes 35 (see FIG. 2). Note, however, that there is no particular limitation on the manner of assembly of the plurality of case parts 21 to 26. Some or all of the plurality of case parts 21 to 26 may be attached together by fastening devices such as the bolts 36 or may be attached together by welding, or the like, without using fastening devices.

The plurality of case parts 21 to 26 are separate from each other and are manufactured separately. Since the plurality of case parts 21 to 26 are separate from each other, the plurality of case parts 21 to 26 do not need to be made of the same material or the same manufacturing method. That is, the plurality of case parts 21 to 26 may be made of the same material or may be made of different materials. The plurality of case parts 21 to 26 may include case parts made of different materials. The plurality of case parts 21 to 26 may use the same manufacturing method or may use different manufacturing methods. The plurality of case parts 21 to 26 may include case parts manufactured by casting and case parts manufactured by forging.

In the present preferred embodiment, the first case part 21 and the second case part 22 are made of die-cast aluminum, for example, and are manufactured by casting. The third case part 23 and the fourth case part 24 are a heat-treated aluminum forged material, for example, and are manufactured by forging. Note, however, that the above description is merely illustrative, and there is no limitation on the material and the manufacturing method of the first to fourth case parts 21 to 24. The third case part 23 and the fourth case part 24 may be a heat-treated gravity-cast material, for example. The mechanical strength of the third case part 23 and the fourth case part 24 is preferably higher than the mechanical strength of the first case part 21 and the second case part 22.

Although not shown in FIG. 2 to FIG. 4, the outboard motor main unit 101 further includes components such as an exhaust pipe to discharge exhaust gas of the engine 1, an oil tank to store oil for the engine 1, and a water pump to supply cooling water to the engine 1. The inside of the upper case 20 may be used as a space for installation of these components. Since the upper case 20 is not a closed case, these components are able to be arranged so as to straddle the inside and the outside of the upper case 20.

Figure 7:
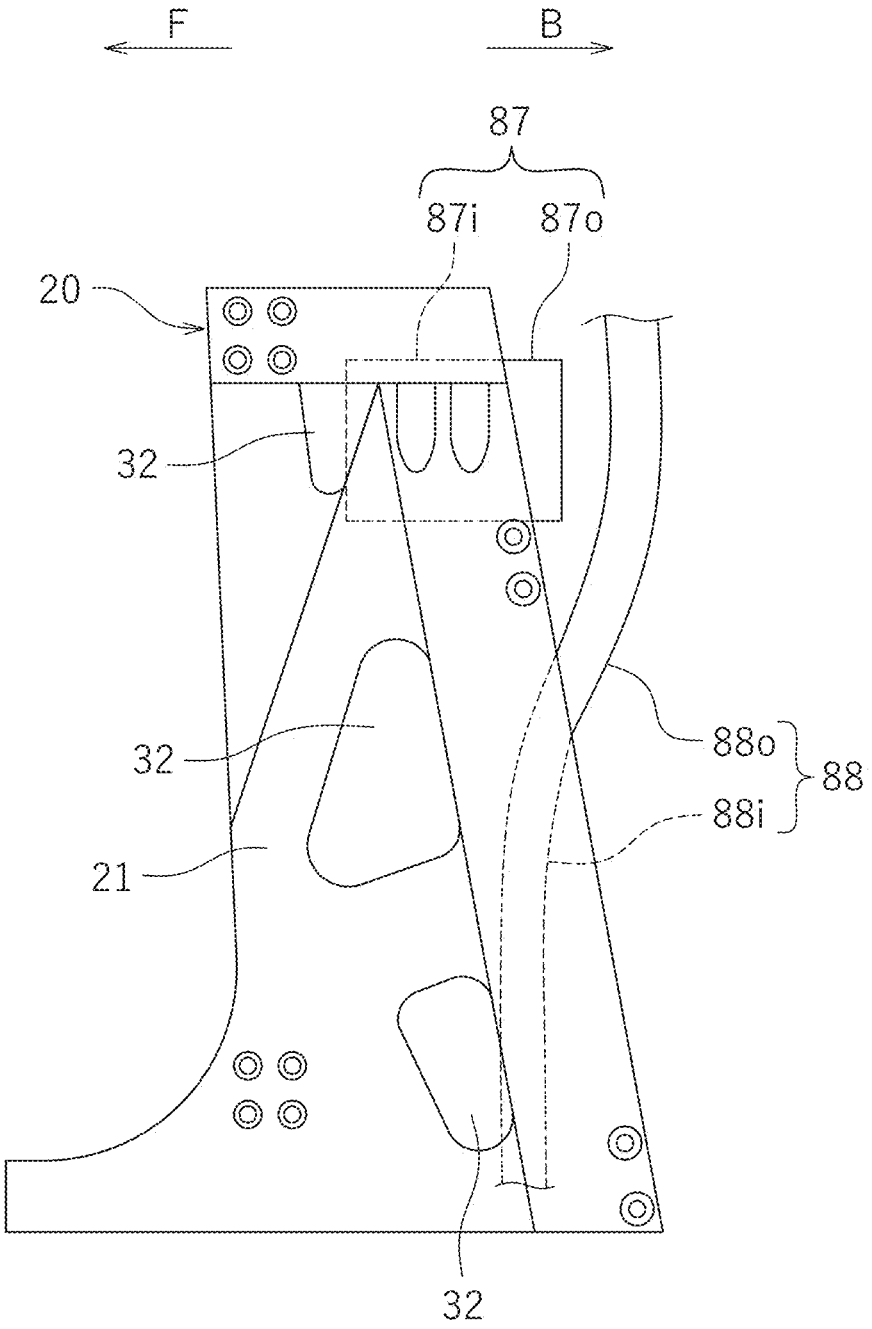
FIG. 7 is a side view showing the outboard motor according to the first preferred embodiment, schematically showing an oil tank and an exhaust pipe.

For example, as shown in FIG. 7, an oil tank 87 and an exhaust pipe 88 may be arranged so as to straddle the inside and the outside of the upper case 20. In the example shown in FIG. 7, the oil tank 87 includes an inner portion 87*i* and an outer portion 87*o*. The exhaust pipe 88 includes an inner portion 88*i* and an outer portion 880. The inner portions 87*i* and 88*i* are located inside the upper case 20, below the upper end of the upper case 20, and above the lower end thereof. The inner portions 87*i* and 88*i* are located below the upper end of the upper case 20, above the lower end thereof, rearward of the front end thereof, and forward of the rear end thereof. The inner portions 87*i* and 88*i* overlap with the upper case 20 as viewed in a side view. On the other hand, the outer portions 87*o* and 88*o* are located outside the upper case 20, below the upper end of the upper case 20, and above the lower end thereof. The outer portions 87*o* and 88*o* do not overlap with the upper case 20 as viewed in a side view.

As shown in FIG. 2, the support member 50 that horizontally rotatably supports the outboard motor main unit 101 includes an upper support member 51 and a lower support member 52 that is spaced apart downward from the upper support member 51. The fourth case part 24 is horizontally rotatably connected to the upper support member 51 by the upper steering shaft 61. The third case part 23 is horizontally rotatably connected to the lower support member 52 by the lower steering shaft 62. The upper steering shaft 61 and the lower steering shaft 62 are arranged on the same axis 60*c* (hereinafter referred to as the steering axis). The drive shaft 7 is inserted through the upper steering shaft 61 and the lower steering shaft 62. The steering axis 60*c* coincides with the axis 7*c* of the drive shaft 7. The outboard motor main unit 101 is able to rotate leftward and rightward about the steering axis 60*c*. The upper steering shaft 61 and the lower steering shaft 62 horizontally rotatably connect the upper case 20 to the support member 50. In the present preferred embodiment, the upper steering shaft 61 and the lower steering shaft 62 are separated from each other. Note, however, that the upper steering shaft 61 and the lower steering shaft 62 may be connected together. The steering shafts may be a single shaft.

A reinforcement member 85 is connected to the upper support member 51 and the lower support member 52. The upper end portion of the reinforcement member 85 is secured to the upper support member 51, and the lower end portion of the reinforcement member 85 is secured to the lower support member 52. The reinforcement member 85 extends rearward and downward, bridging between the upper support member 51 and the lower support member 52.

The attachment member 70 is attached to a rear portion of the hull 11. The support member 50 is vertically rotatably connected to the attachment member 70 by a tilt shaft 65 extending in the left-right direction. The tilt shaft 65 vertically rotatably links the support member 50 to the attachment member 70. Here, the attachment member 70 is vertically rotatably connected to the upper support member 51 by the tilt shaft 65.

A tilt cylinder 80 is connected to the attachment member 70 and the support member 50. The tilt cylinder 80 is vertically rotatably connected to the attachment member 70 and the support member 50. Specifically, the tilt cylinder 80 includes a cylinder 81 and a rod 82. An upper end portion 81*a* of the cylinder 81 is vertically rotatably connected to the attachment member 70. A lower end portion 82*a* of the rod 82 is vertically rotatably connected to the lower support member 52. The support member 50 and the outboard motor main unit 101 rotate about the tilt shaft 65 as the rod 82 extends and retracts. In FIG. 2, the support member 50 and the outboard motor main unit 101 rotate counterclockwise when the rod 82 extends, and rotates clockwise when the rod 82 retracts.

The outboard motor 100 according to the present preferred embodiment is configured as described above. Next, various advantageous effects of the outboard motor 100 according to the present preferred embodiment will be described.

With the outboard motor 100 according to the present preferred embodiment, the upper case 20 is obtained by assembling together the plurality of case parts 21 to 26. As compared with the upper case 20 which is formed as a single part, the plurality of case parts 21 to 26 each have a relatively simple and small configuration. Therefore, it is possible to relatively easily manufacture the upper case 20 even when the upper case 20 has a complicated or large configuration.

The plurality of case parts 21 to 26 include the first case part 21 and the second case part 22 that oppose each other in the direction perpendicular to the axis 7*c* of the drive shaft 7. Even when the size of the upper case 20 in the up-down direction (the size in the direction of the axis 7*c* of the drive shaft 7) is large, it is possible to easily manufacture the first case part 21 and the second case part 22. When the first case part 21 and the second case part 22 are assembled on top of each other, they need to have a flange, which leads to an increase in weight, but there is no need for such a flange in the present preferred embodiment. With the outboard motor 100 according to the present preferred embodiment, even when the upper case 20 has a complicated or large configuration, it is possible to prevent an increase in weight while providing a sufficient mechanical strength.

The drive shaft 7 is located between the first case part 21 and the second case part 22. Thus, the first case part 21 and the second case part 22 are able to guide the drive shaft 7 downward from the engine 1 toward the propulsion unit 5.

The upper case 20 includes the upper plate part 25 to which the engine 1 is attached, and the lower plate part 26 to which the propulsion unit 5 is attached. The first case part 21 and the second case part 22 each extend in the up-down direction. Thus, it is possible to prevent an increase in weight while providing a sufficient mechanical strength of the upper case 20.

The first case part 21 is located leftward of the drive shaft 7, and the second case part 22 is located rightward of the drive shaft 7. Thus, the configuration of the upper case 20 is relatively simple.

The upper case 20 includes the third case part 23 that bridges the first case part 21 and the second case part 22. Thus, the configuration of the upper case 20 is relatively simple while providing a sufficient mechanical strength.

According to the present preferred embodiment, the third case part 23 extends perpendicular or substantially perpendicular to the first case part 21 and the second case part 22. Thus, it is possible to provide a sufficient mechanical strength of the upper case 20.

The plurality of case parts 21 to 26 of the upper case 20 are separate from each other. The plurality of case parts 21 to 26 are separately manufactured. Therefore, there is no such limitation that the plurality of case parts 21 to 26 need to be made of the same material. In the present preferred embodiment, the plurality of case parts 21 to 26 of the upper case 20 include case parts made of different materials. With the outboard motor 100 according to the present preferred embodiment, there are fewer limitations on the materials used in the upper case 20. By appropriately selecting the material of each of the plurality of case parts 21 to 26, it is possible to prevent an increase in weight while providing a sufficient mechanical strength of the upper case 20.

According to the present preferred embodiment, there is no such limitation that the plurality of case parts 21 to 26 need to use the same manufacturing method. In the present preferred embodiment, the plurality of case parts 21 to 26 of the upper case 20 include the plurality of case parts 21 and 22 manufactured by casting and the plurality of case parts 23 and 24 manufactured by forging, for example. According to the present preferred embodiment, by appropriately selecting the manufacturing method for each of the plurality of case parts 21 to 26, it is possible to relatively easily manufacture the upper case 20 and to prevent an increase in weight while providing a sufficient mechanical strength even when the upper case 20 has a complicated or large configuration.

The first case part 21 and the second case part 22 include the reinforcement ribs 33 in addition to the main body 31 (see FIG. 6). The reinforcement ribs 33 include the horizontal rib 33*h* extending in a direction perpendicular or substantially perpendicular to a direction parallel to the axis 7*c* of the drive shaft 7, and the slanted ribs 33*a* to 33*e* slanted relative to a direction parallel to the axis 7*c* of the drive shaft 7. When the upper case is produced as a single tubular part that is manufactured by casting as with conventional techniques, it is difficult to provide the horizontal rib and the slanted ribs. However, according to the present preferred embodiment, it is easy to provide the horizontal rib 33*h* and the slanted ribs 33*a* to 33*e* on the first case part 21 and the second case part 22. Therefore, it is possible to increase the mechanical strength of the first case part 21 and the second case part 22 without increasing the thickness of the main body 31. Thus, it is possible to prevent an increase in weight while providing a sufficient mechanical strength of the upper case 20.

As shown in FIG. 2, the propulsion unit 5 is connected to a lower portion of the upper case 20. While the propeller 3 of the propulsion unit 5 rotates to generate forward propulsion, the rear portion of the upper case 20 is pulled rearward and downward. Reference sign F1 in FIG. 2 denotes the pulling force generated at the rear portion of the upper case 20. In the present preferred embodiment, the first case part 21 and the second case part 22 include the slanted ribs 33*a* to 33*c* extending rearward and downward (see FIG. 6). Therefore, it is possible to provide a sufficient mechanical strength of the upper case 20 for the pulling force F1.

As shown in FIG. 5, the through holes 32 are provided in the first case part 21 and the second case part 22. Note that, as opposed to the bolt holes 35 in which the bolts 36 are inserted, the through holes 32 are open when the upper case 20 is assembled (see FIG. 2). The through holes 32 are always open without being closed by the bolts 36, etc. With the through holes 32 in the first case part 21 and the second case part 22, it is possible to reduce the weight of the first case part 21 and the second case part 22. Thus, it is possible to reduce the weight of the upper case 20.

As shown in FIG. 7, in the present preferred embodiment, the oil tank 87 includes the inner portion 87*i* located inside the upper case 20 and the outer portion 87*o* located outside the upper case 20. The exhaust pipe 88 includes the inner portion 88*i* located inside the upper case 20 and the outer portion 88*o* located outside the upper case 20. Since the upper case 20 does not have a closed tubular shape, the oil tank 87 and the exhaust pipe 88 are able to straddle the inside and the outside of the upper case 20. According to the present preferred embodiment, there is a high degree of freedom in the arrangement of parts such as the oil tank 87 and the exhaust pipe 88.

The upper case 20 includes the fourth case part 24 through which the upper steering shaft 61 is inserted and the third case part 23 through which the lower steering shaft 62 is inserted. The upper steering shaft 61 and the lower steering shaft 62 are located inside the upper case 20. Therefore, as compared with a case in which the steering shafts are located forward of the upper case 20, it is possible to reduce the size of the outboard motor 100.

The upper case 20 includes the first reinforcement member 27 secured to the first case part 21 and the second case part 22. The upper case 20 also includes the second reinforcement member 28 secured to the first case part 21, the second case part 22, and the upper plate part 25. With the first reinforcement member 27 and the second reinforcement member 28, it is possible to further increase the mechanical strength of the upper case 20.

Second Preferred Embodiment

The outboard motor 100 according to the second preferred embodiment of the present invention is similar to the outboard motor 100 according to the first preferred embodiment, with a change made to the configuration of the upper case 20. In the following description, like elements to those of the first preferred embodiment will be denoted by like reference signs, and will not be further described below.

Figure 8:
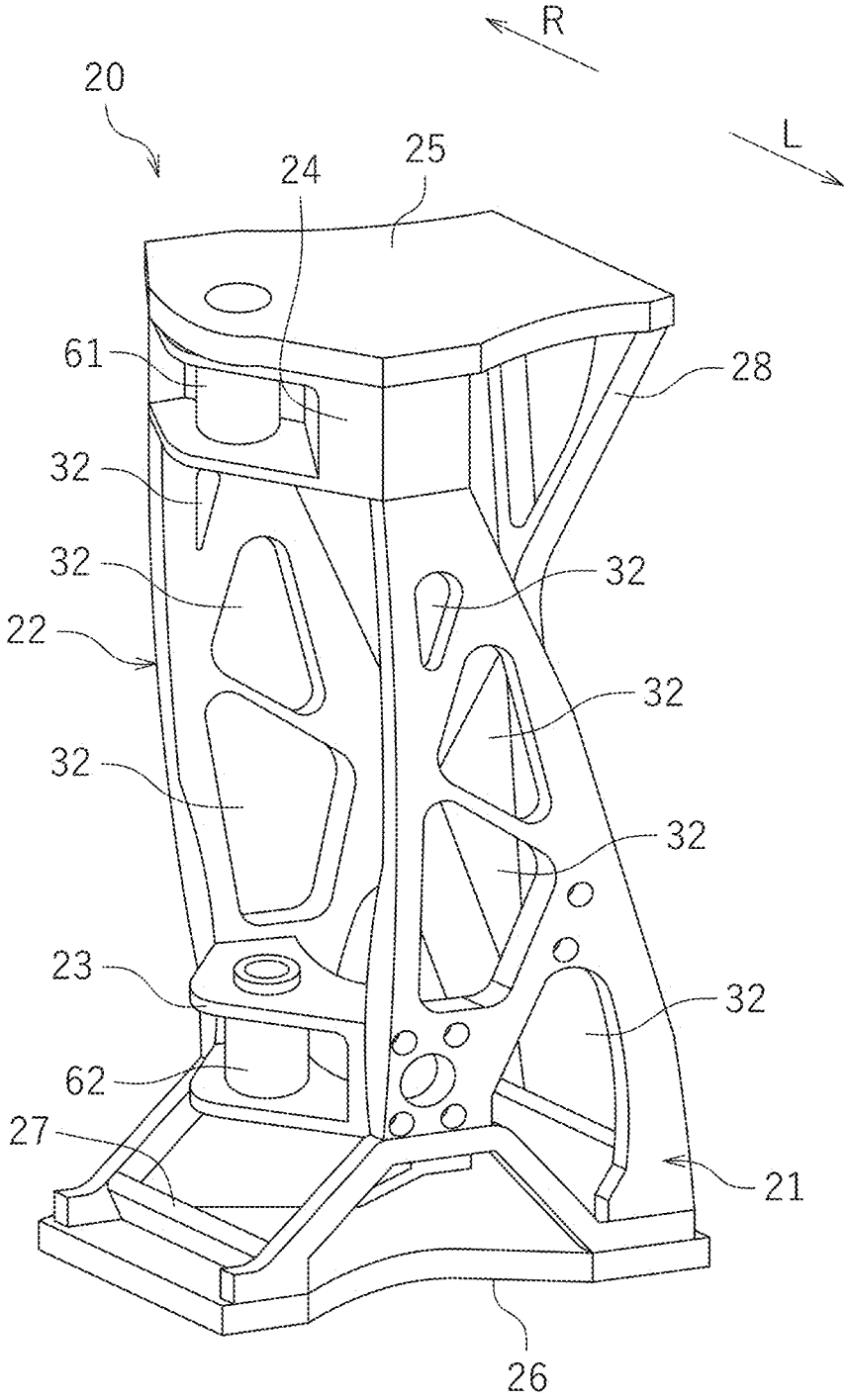
FIG. 8 is a perspective view showing an upper case of an outboard motor according to a second preferred embodiment of the present invention.

FIG. 8 is a perspective view showing the upper case 20 of the outboard motor 100 according to the second preferred embodiment. As in the first preferred embodiment, the upper case 20 is obtained by assembling together the first case part 21, the second case part 22, the third case part 23, the fourth case part 24, the upper plate part 25, and the lower plate part 26. Although not shown in the figure, the engine 1 is attached to the upper plate part 25, and the propulsion unit 5 is attached to the lower plate part 26.

The configuration of the first case part 21 and the second case part 22 according to the second preferred embodiment is different from the configuration of the first case part 21 and the second case part 22 according to the first preferred embodiment. In the second preferred embodiment, reinforcement ribs are not provided on the first case part 21 and the second case part 22. Note, however, that also in the second preferred embodiment, the first case part 21 and the second case part 22 includes the through holes 32 that open leftward and rightward. The first case part 21 is located leftward of the steering shaft (not shown), and the second case part 22 is located rightward of the steering shaft.

The first reinforcement member 27 is connected to the first case part 21 and the second case part 22. The first reinforcement member 27 extends in the left-right direction, bridging the first case part 21 and the second case part 22. In the present preferred embodiment, the first reinforcement member 27 is located below the third case part 23. The second reinforcement member 28 is connected to the first case part 21, the second case part 22, and the upper plate part 25.

Figure 9:
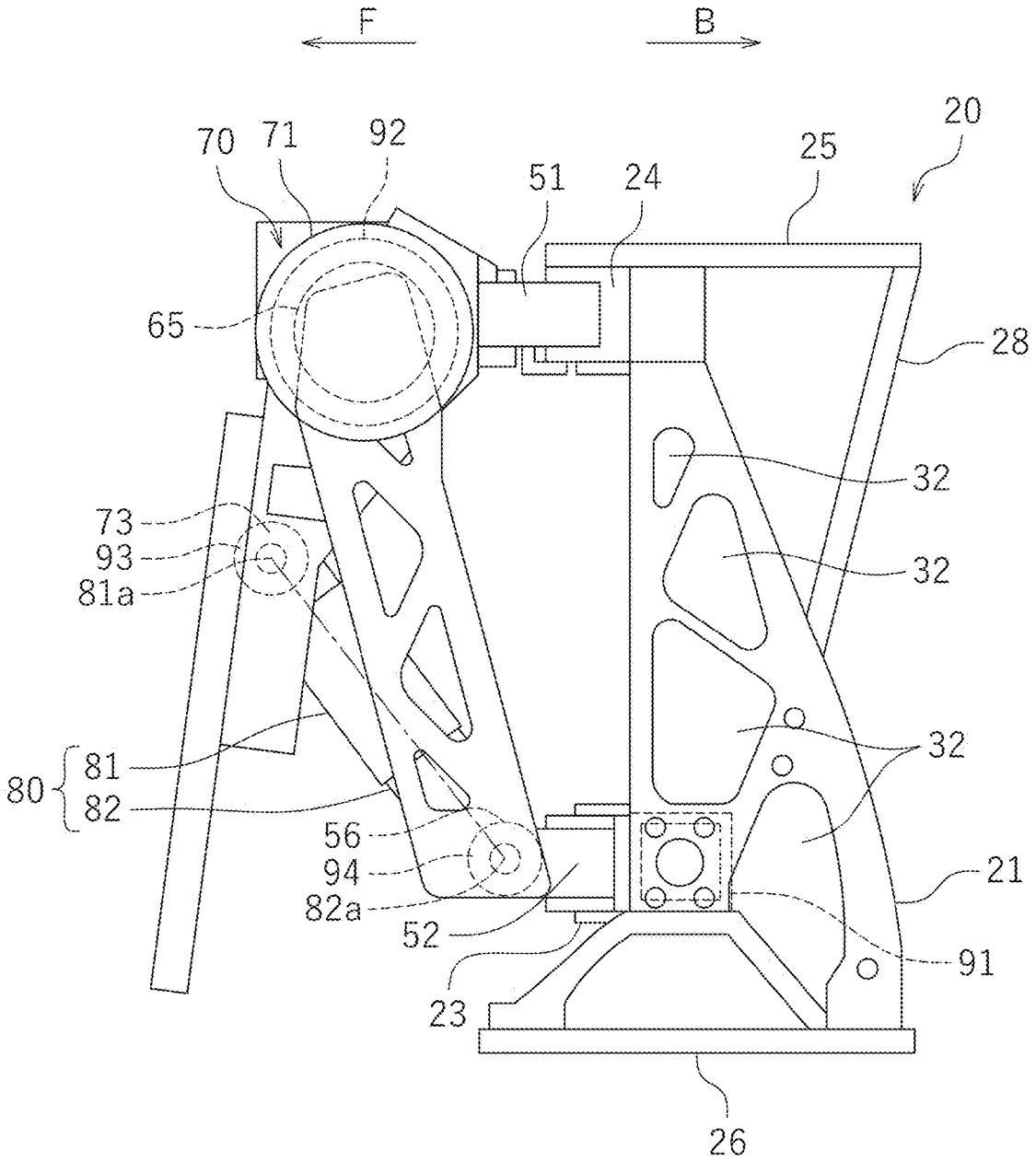
FIG. 9 is a side view showing a portion of the outboard motor according to the second preferred embodiment of the present invention.

As shown in FIG. 9, the upper steering shaft 61 (see FIG. 8) is inserted through the fourth case part 24, and the upper support member 51 is attached to the upper steering shaft 61. The lower steering shaft 62 (see FIG. 8) is inserted through the third case part 23, and the lower support member 52 is attached to the lower steering shaft 62. The upper case 20 is horizontally rotatably supported on the upper support member 51 and the lower support member 52. Although not shown in the figure, also in the present preferred embodiment, the drive shaft 7 is inserted through the upper steering shaft 61 and the lower steering shaft 62 (see FIG. 2). The axes of the upper steering shaft 61, the lower steering shaft 62, and the drive shaft 7 coincide with each other.

The upper support member 51 is vertically rotatably supported on the attachment member 70 by the tilt shaft 65 extending in the left-right direction. The lower support member 52 is vertically rotatably supported on the attachment member 70 via the tilt cylinder 80.

Figure 10:
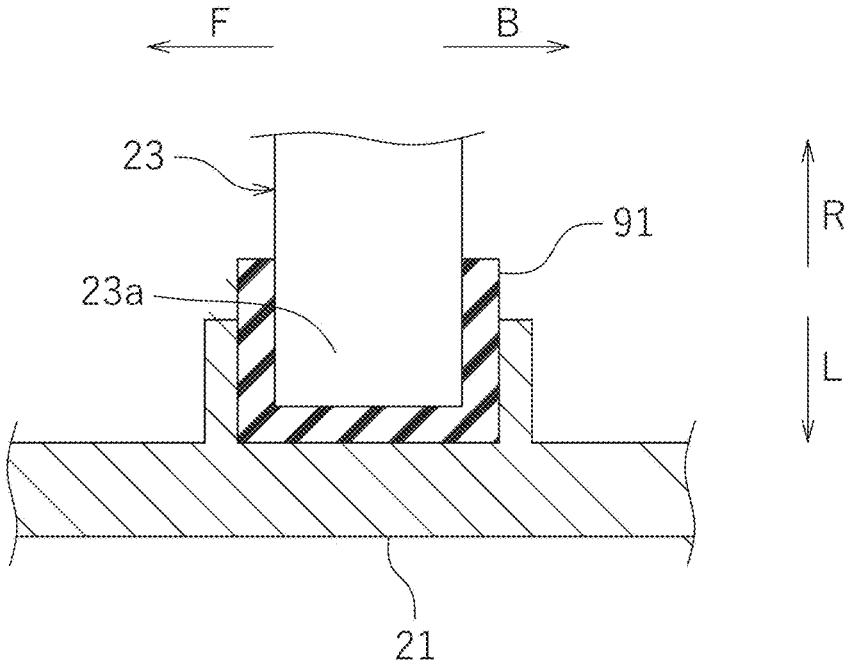
FIG. 10 is a cross-sectional view showing a damper located between a third case part and a first case part.

In the present preferred embodiment, a rubber damper 91 is located between the third case part 23 and the first case part 21 and between the third case part 23 and the second case part 22. As shown in FIG. 10, the third case part 23 and the first case part 21 are assembled together with the damper 91 therebetween. A left end portion 23*a* of the third case part 23 and the first case part 21 are not in direct contact with each other but are in indirect contact with each other with the damper 91 therebetween. Although not shown in the figure, the right end portion of the third case part 23 and the second case part 22 are not in direct contact with each other but are in indirect contact with each other with the damper 91 therebetween.

Figure 11:
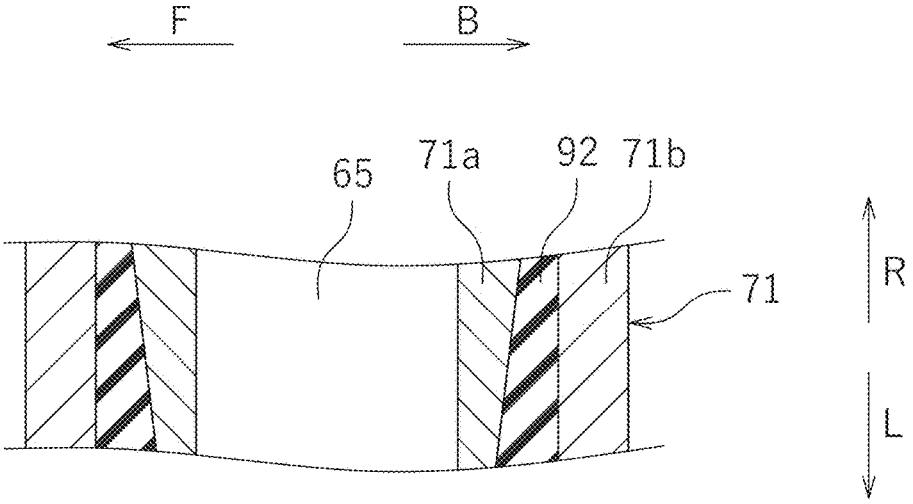
FIG. 11 is a cross-sectional view showing a damper provided on a tilt shaft support portion of an attachment member.

As shown in FIG. 9, the attachment member 70 includes the tilt shaft support portion 71 that supports the tilt shaft 65. A damper 92 is provided on the tilt shaft support portion 71. As shown in FIG. 11, the tilt shaft support portion 71 includes an inner member 71*a* and an outer member 71*b* each having a cylindrical shape. The inner member 71*a* is located on the inner side of the outer member 71*b*. The tilt shaft 65 is rotatably supported on the inner member 71*a*. The damper 92 is made of rubber, for example, and is located between the inner member 71*a* and the outer member 71*b*. The shape of the damper 92 is preferably tubular and tapered.

As shown in FIG. 9, the attachment member 70 includes a connecting portion 73 to which the tilt cylinder 80 is connected. The upper end portion 81*a* of the cylinder 81 of the tilt cylinder 80 is connected to the connecting portion 73. A rubber damper 93 is provided on the connecting portion 73. The lower support member 52 includes a connecting portion 56 to which the tilt cylinder 80 is connected. The lower end portion 82*a* of the rod 82 of the tilt cylinder 80 is connected to the connecting portion 56. A rubber damper 94 is provided on the connecting portion 56.

Also in the second preferred embodiment, similar advantageous effects to those of the first preferred embodiment can be realized. In addition, according to the present preferred embodiment, it is possible, with the dampers 91 to 94, to reduce vibrations transmitted to the hull 11 from the engine 1 and the propulsion unit 5.

Alternative Preferred Embodiments

While the first preferred embodiment and the second preferred embodiment have been described above, the first preferred embodiment and the second preferred embodiment are merely illustrative, and various alternative preferred embodiments are possible. Alternative preferred embodiments will now be described briefly.

Figure 12:
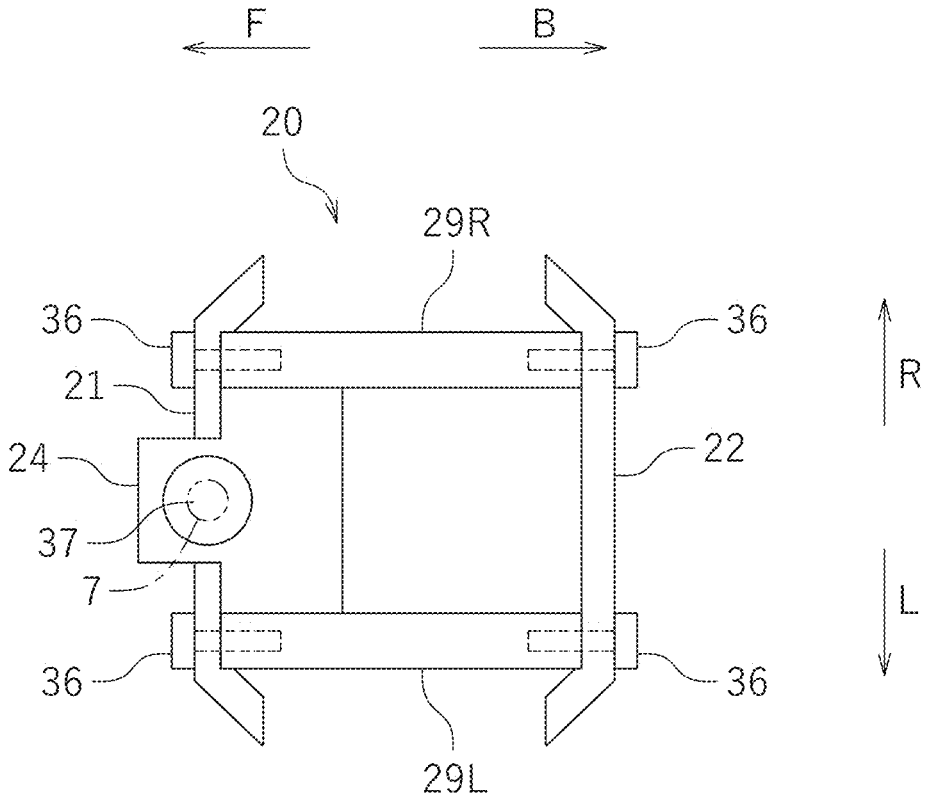
FIG. 12 is a plan view schematically showing a configuration of an upper case of an outboard motor according to an alternative preferred embodiment of the present invention.

The first case part 21 and the second case part 22 do not always need to be located leftward and rightward, respectively, of the drive shaft 7. The first case part 21 and the second case part 22 do not always need to oppose each other in the left-right direction. For example, as schematically shown in FIG. 12, the first case part 21 and the second case part 22 may be located so as to oppose each other in the front-rear direction. In the example shown in FIG. 12, the upper case 20 includes a left case part 29L and a right case part 29R extending in the front-rear direction, in addition to the first to fourth case parts 21 to 24. The left case part 29L and the right case part 29R are connected to the first case part 21 and the second case part 22, bridging the first case part 21 and the second case part 22.

In the preferred embodiments described above, the upper case 20 includes the upper plate part 25 and the lower plate part 26. However, while the upper plate part 25 stably supports the engine 1, the upper plate part 25 is not always needed. The upper plate part 25 may be absent as long as the engine 1 is stably supported. While the lower plate part 26 stably supports the propulsion unit 5, the lower plate part 26 is not always needed. The lower plate part 26 may be absent as long as the propulsion unit 5 is stably supported.

While the upper case 20 includes the third case part 23 and the fourth case part 24 bridging the first case part 21 and the second case part 22 in the preferred embodiments described above, the third case part 23 and the fourth case part 24 are not always needed. The first case part 21 and the second case part 22 may be indirectly connected together or may be directly connected together.

The upper case 20 may or may not include the reinforcement ribs 33. The first case part 21 and the second case part 22 may include the reinforcement ribs 33 as in the first preferred embodiment or may not include the reinforcement ribs 33. Other case parts 23 to 26 may include the reinforcement ribs 33.

The first case part 21 and the second case part 22 may not include the through holes 32. Other case parts 23 to 26 may include the through holes 32.

The steering shaft may not be inserted through the upper case 20. The plurality of case parts of the upper case 20 may not include a case part through which the steering shaft is inserted. The steering shaft may be located forward of the upper case 20.

As in the second preferred embodiment, some or all of the dampers 91 to 94 may be provided in the outboard motor 100 according to the first preferred embodiment. In the outboard motor 100 according to the second preferred embodiment, some or all of the dampers 91 to 94 may be absent. In the outboard motor 100, the dampers 91 to 94 may or may not be provided.

While the first reinforcement member 27 and the second reinforcement member 28 are effective to increase the mechanical strength of the upper case 20, one or both of the first reinforcement member 27 and the second reinforcement member 28 may be absent as long as a sufficient mechanical strength is provided for the upper case 20. The upper case 20 may include other reinforcement members that connect together two or more case parts.

The terms and expressions used herein are used for explanation purposes and should not be construed as being restrictive. It should be appreciated that the terms and expressions used herein do not eliminate any equivalents of features illustrated and mentioned herein, but include various modifications falling within the claimed scope of the present invention. The present invention may be embodied in many different forms. The present disclosure is to be considered as providing examples of the principles of the present invention. These examples are described herein with the understanding that such examples are not intended to limit the present invention to preferred embodiments described herein and/or illustrated herein. Hence, the present invention is not limited to the preferred embodiments described herein. The present invention includes any and all preferred embodiments including equivalent elements, modifications, omissions, combinations, adaptations and/or alterations as would be appreciated by those skilled in the art on the basis of the present disclosure. The limitations in the claims are to be interpreted broadly based on the language included in the claims and not limited to examples described in the present specification or during the prosecution of the application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine;

a propulsion unit located below the engine and including a propeller;

a drive shaft connected to the engine and the propulsion unit to transmit a drive force from the engine to the propulsion unit; and a case located between the engine and the propulsion unit and including an engine attachment portion to which the engine is attached and a propulsion unit attachment portion to which the propulsion unit is attached; wherein the case includes a plurality of case parts that are separate from each other and assembled together;

the plurality of case parts includes a first case part and a second case part opposing each other in a direction perpendicular or substantially perpendicular to an axis of the drive shaft; and the first case part and the second case part are made of one of a cast material and a forged material.

2. The outboard motor according to claim 1, wherein the drive shaft is located between the first case part and the second case part.

3. The outboard motor according to claim 1, wherein the plurality of case parts include an upper plate part to which the engine is attached and a lower plate part to which the propulsion unit is attached;

the engine attachment portion of the case is the upper plate part;

the propulsion unit attachment portion of the case is the lower plate part; and the first case part and the second case part each extend in an up-down direction.

4. The outboard motor according to claim 1, wherein the first case part is located leftward of the drive shaft, and the second case part is located rightward of the drive shaft.

5. The outboard motor according to claim 1, wherein the plurality of case parts include a third case part that connects to the first case part to the second case part.

6. The outboard motor according to claim 5, wherein the third case part extends perpendicular or substantially perpendicular to the first case part and the second case part.

7. The outboard motor according to claim 1, wherein the plurality of case parts include case parts made of different materials.

8. The outboard motor according to claim 1, wherein one of the plurality of case parts is made of the cast material and another one of the plurality of case parts is made of the forged material.

9. The outboard motor according to claim 1, wherein the first case part and/or the second case part includes a reinforcement rib extending in a direction perpendicular to or slanted relative to a direction parallel to an axis of the drive shaft.

10. The outboard motor according to claim 1, wherein the first case part and/or the second case part includes a reinforcement rib extending rearward and downward.

11. The outboard motor according to claim 1, wherein the first case part and/or the second case part includes a through hole that opens in a direction perpendicular or substantially perpendicular to an axis of the drive shaft.

12. The outboard motor according to claim 1, further comprising a part including:

an inner portion located inside the case, below an upper end of the case, and above a lower end of the case; and an outer portion located outside the case, below the upper end of the case, and above the lower end of the case.

13. The outboard motor according to claim 1, further comprising:

an attachment to be attached to a hull;

a support attached to the attachment and the case;

a tilt shaft that vertically rotatably links the support to the attachment; and a steering shaft that horizontally rotatably links the case to the support.

14. The outboard motor according to claim 13, wherein the plurality of case parts includes a case part in which the steering shaft is inserted.

15. The outboard motor according to claim 13, further comprising a damper located between any two of the plurality of case parts.

16. The outboard motor according to claim 13, wherein the attachment includes a tilt shaft support portion that supports the tilt shaft; and a damper is provided on the tilt shaft support portion.

17. The outboard motor according to claim 13, further comprising:

a tilt cylinder connected to the attachment and the support; wherein the attachment and/or the support includes a connector connected to the tilt cylinder; and a damper is provided on the connector.

18. The outboard motor according to claim 1, further comprising a reinforcement secured to at least two of the plurality of case parts.

* * * * *